US007561148B2

(12) United States Patent
Lee et al.

(10) Patent No.: US 7,561,148 B2
(45) Date of Patent: Jul. 14, 2009

(54) PLASMA DISPLAY PANEL DRIVING METHOD

(75) Inventors: Jun-Young Lee, Suwon-si (KR); Byung-Gwon Cho, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 617 days.

(21) Appl. No.: 11/044,869

(22) Filed: Jan. 26, 2005

(65) Prior Publication Data

US 2005/0168407 A1 Aug. 4, 2005

(30) Foreign Application Priority Data

Jan. 29, 2004 (KR) ..... 10-2004-0005882

(51) Int. Cl.
*G09G 5/00* (2006.01)

(52) U.S. Cl. ..... 345/204; 345/60; 345/63; 315/169.3; 315/169.4

(58) Field of Classification Search ..... 345/204, 345/60, 63; 315/169.3–169.4
See application file for complete search history.

(56) References Cited

U.S. PATENT DOCUMENTS 6,744,200 B2 * 6/2004 Makino ..... 313/582
7,164,395 B2 * 1/2007 Myoung et al. ..... 345/60

FOREIGN PATENT DOCUMENTS

| | | | |
|---|---|---|---|
| CN | 1409284 | A | 4/2003 |
| CN | 1438619 | A | 8/2003 |
| EP | 1 065 650 | A2 | 1/2001 |
| KR | 2003-0027173 | | 4/2003 |
| WO | WO 2004/032108 | A1 | 4/2004 |

OTHER PUBLICATIONS

Korean Patent Abstracts for Publication No. 1020030027173; Date of publication of application Apr. 7, 2003, in the name of Seong Won Ji.

* cited by examiner

*Primary Examiner*—Richard Hjerpe
*Assistant Examiner*—Leonid Shapiro
(74) *Attorney, Agent, or Firm*—Christie Parker & Hale LLP

(57) ABSTRACT

A driving method of a plasma display panel, the plasma display panel including a plurality of first electrodes and a plurality of second electrodes, and a plurality of third electrodes which lie in a direction perpendicular to that of the first electrodes and the second electrodes. The second electrode is biased at a first voltage during the reset period, the address period, and the sustain period. A voltage of the first electrode is increased from a second voltage to a third voltage. The voltage of the first electrode is decreased from a fourth voltage to a fifth voltage during the reset period. The fifth voltage is lower than the lower voltage among the voltages that are applied for a sustain discharge in the sustain period.

8 Claims, 10 Drawing Sheets

PLASMA DISPLAY PANEL DRIVING METHOD

CROSS REFERENCE TO RELATED APPLICATION

This application claims priority to and the benefit of Korean Patent Application No. 10-2004-0005882 filed on Jan. 29, 2004 in the Korean Intellectual Property Office, the entire content of which is incorporated herein by reference.

BACKGROUND OF THE INVENTION (a) Field of the Invention

The present invention relates to a driving method of a plasma display panel (PDP).

(b) Description of the Related Art

The PDP is a flat display device for displaying characters or images using plasma caused by gas discharge, and several tens to several millions of pixels are arranged in a matrix format on the PDP according to the PDP size. The PDP is classified into an AC type and a DC type according to a driving voltage waveform and structure of a discharge cell.

In the DC PDP, electrodes are directly exposed in a discharge space and thus current directly flows in the discharge space when voltage is applied. Thus a resistor is required to restrict the current. However, in the AC PDP, electrodes are covered with a dielectric layer. Thus, naturally occurring capacitance restricts the current, and the electrodes are protected from ion impulses when discharge occurs. The life of the AC PDP is therefore longer than the life of the DC PDP.

The AC PDP includes a plurality of scan electrodes and a plurality of sustain electrodes which are arranged in parallel on one substrate. A plurality of address electrodes are arranged on an opposite substrate and lie in a direction perpendicular to the scan electrodes and sustain electrodes. The sustain electrodes are arranged corresponding to each scan electrode. One end of the sustain electrodes are commonly connected.

FIG. 1 is a partial perspective view of an AC PDP. The PDP includes two glass substrates 1, 6, which are arranged in a face-to-face relationship. On the first substrate 1, pairs of a scan electrode 4 and a sustain electrode 5 which are covered with a dielectric layer 2 and a protective layer 3 are arranged in parallel. On the second substrate 6, a plurality of address electrodes 8, which are covered with an insulating layer 7, are arranged. Barrier ribs 9 are formed in parallel with the address electrodes 8 on the insulating layer 7. A fluorescent material 13 is formed on the surface of the insulating layer 7 between the barrier ribs 9 and on both sides of the barrier ribs 9. The glass substrates 1, 6 are arranged in a face-to-face relationship with a discharge space 11 formed therebetween, such that the scan electrodes 4 and the sustain electrodes 5 lie in a direction perpendicular to the address electrodes 8. A discharge space 11 at intersections of the address electrodes 8 and the pairs of scan electrode 4 and sustain electrode 5 forms discharge cells 12.

FIG. 2 shows a driving waveform of an AC PDP. Generally, in the PDP, one frame is divided into a plurality of subfields, and is driven. Each subfield includes a reset period, an address period, a sustain period, and an erase period. The reset period is a period for erasing wall charges that have been formed by a previous sustain discharge, and setting up a new wall charge in order to stably perform a next address discharge. The address period is a period for selecting cells being turned on and cells being turned off, and accumulating a wall charge on cells being turned on (addressed cell). The sustain period is a period for performing a sustain discharge to display a video image on an addressed cell. The erase period is a period for decreasing the wall charge of the discharge cell and terminating the sustain discharge.

To achieve the above operation, as shown in FIG. 2, a sustain discharge pulse is alternatingly applied to a scan electrode and a sustain electrode in the sustain period, and a gradually rising ramp voltage is applied to the sustain electrode X in the erase period following the sustain period. Then, a reset waveform is applied to the scan electrode Y, under a condition that the address electrode A is maintained at a ground (0V) voltage and the sustain electrode X is biased at a predetermined voltage. Then, in the address period, an address waveform is applied to the scan electrode Y and the address electrode A to select a discharge cell that is desired to be displayed when the scan electrode Y and the sustain electrode X are respectively maintained at the predetermined voltage.

However, for the conventional driving method of the PDP, a scan driving board for driving a scan electrode Y, a sustain driving board for driving a sustain electrode X and an address driving board for driving an address electrode A are respectively required. Thus, three driving boards are required to be built in a chassis base, increasing the cost.

SUMMARY OF THE INVENTION

In accordance with the preserit invention, a driving method of a PDP is provided which is capable of preventing an erroneous discharge, without a sustain driving board. In an exemplary embodiment a sustain electrode is grounded and a driving waveform is applied to a scan electrode.

One aspect of the present invention is a driving method of a PDP having a plurality of first electrodes, a plurality of second electrodes, and a plurality of third electrodes which lie in a direction perpendicular to the first electrodes and the second electrodes. A subfield has a reset period, an address period, and a sustain period. The driving method includes biasing the second electrode at a first voltage during the reset period, the address period, and the sustain period; increasing a voltage of the first electrode from a second voltage to a third voltage; and decreasing the voltage of the first electrode from a fourth voltage to a fifth voltage during the reset period. Here, the fifth voltage is lower than the lower voltage among the voltages that are applied for a sustain discharge in the sustain period. Further, the first voltage is a grounded voltage, and a voltage difference between the fifth voltage and the first voltage is a discharge firing voltage.

Another aspect of the present invention is to provide a driving method of a PDP, the driving method including: biasing the second electrode at a first voltage during the reset period, the address period, and the sustain period; increasing a voltage of the first electrode from a second voltage to a third voltage and applying a fourth voltage to the third electrode; and decreasing the voltage of the first electrode from the fifth voltage to the sixth voltage and applying a seventh voltage to the third electrode in the reset period.

Here, the fourth voltage is a voltage which is applied to the third electrode for forming a discharge cell that is desired to be selected in the address period. The seventh voltage is a voltage which is applied to the third electrode for forming a discharge cell that is desired to be not selected in the address period.

DETAILED DESCRIPTION

Figure 3:
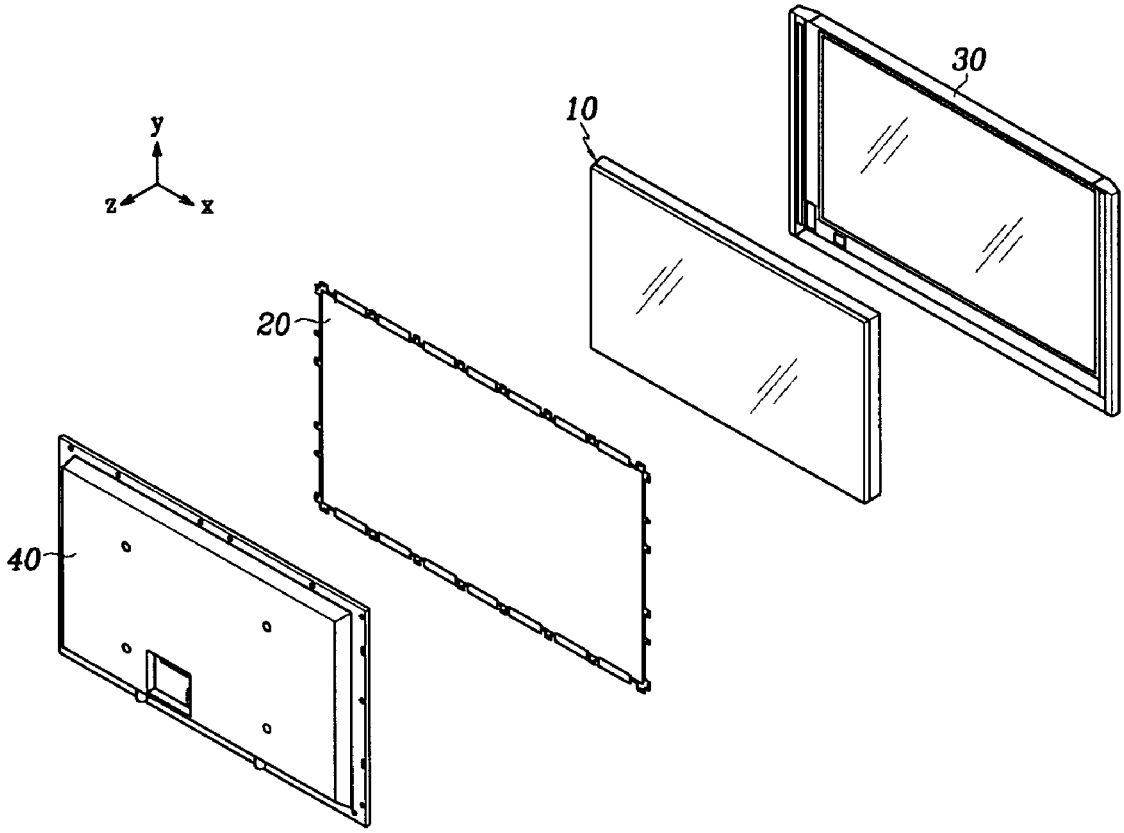
FIG. 3 shows is a perspective view of a PDP according to an exemplary embodiment of the present invention.

First, a simplified structure of a plasma display device according to an exemplary embodiment of the present invention is described in more detail with reference to FIG. 3, FIG. 4 and FIG. 5. As shown in FIG. 3, the plasma display device includes a PDP 10, a chassis base 20, a front case 30, and a rear case 40.

The chassis base 20 is coupled with the PDP 10 such that the chassis base 20 is arranged on a side opposite that of an image display side. The front case 30 is arranged on the front side to the PDP 10 and the rear case 40 is arranged on the rear side to the chassis base 20. The front case 30 and the rear case 40 are assembled with the PDP and the chassis base 20 to form a plasma display device.

Figure 1:
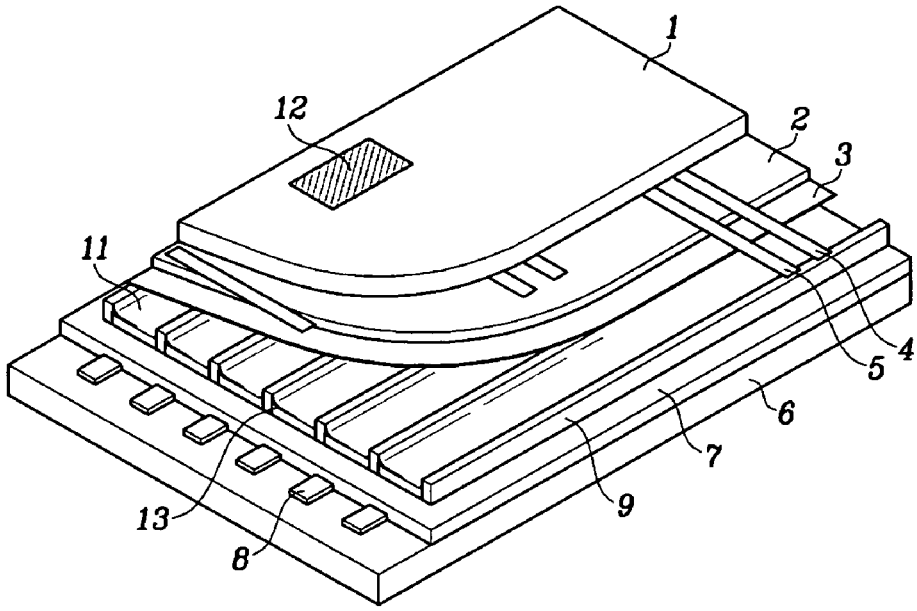
FIG. 1 is a partial perspective view of an AC PDP.
Figure 4:
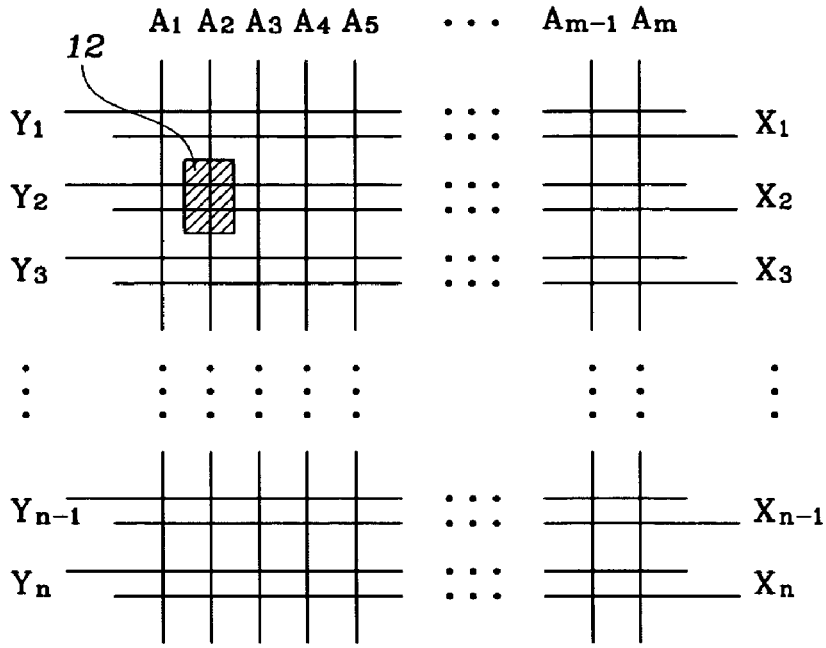
FIG. 4 is a simplified diagram of a PDP according to an exemplary embodiment of the present invention.

Referring now to FIG. 4, the PDP 10 shown in FIG. 3 includes a plurality of address electrodes $A_1$ to $A_m$ extended in a column direction, and a plurality of pairs of scan electrodes $Y_1$ to $Y_n$ and sustain electrodes $X_1$ to $X_n$ extended in a row direction. The sustain electrodes $X_1$ to $X_n$ are each arranged corresponding to a scan electrodes $Y_1$ to $Y_n$ as pairs, and one end of the sustain electrodes are coupled in common. Further, the PDP includes an insulated substrate wherein a plurality of scan electrodes $Y_1$ to $Y_n$ and a plurality of sustain electrodes $X_1$ to $X_n$ are arranged, and an insulated substrate wherein a plurality of address electrodes $A_1$ to $A_m$ are arranged. The two insulated substrates are arranged in a face-to-face relationship with a discharge space formed therebetween, such that the scan electrodes $Y_1$ to $Y_n$ and the sustain electrodes $X_1$ to $X_n$ lie in a direction perpendicular to the address electrodes $A_1$ to $A_m$. Comparable to the PDP of FIG. 1, discharge spaces form discharge cells 12 at intersections of the address electrodes $A_1$ to $A_m$, and the scan electrodes $Y_1$ to $Y_n$ and the sustain electrodes $X_1$ to $X_n$.

Figure 2:
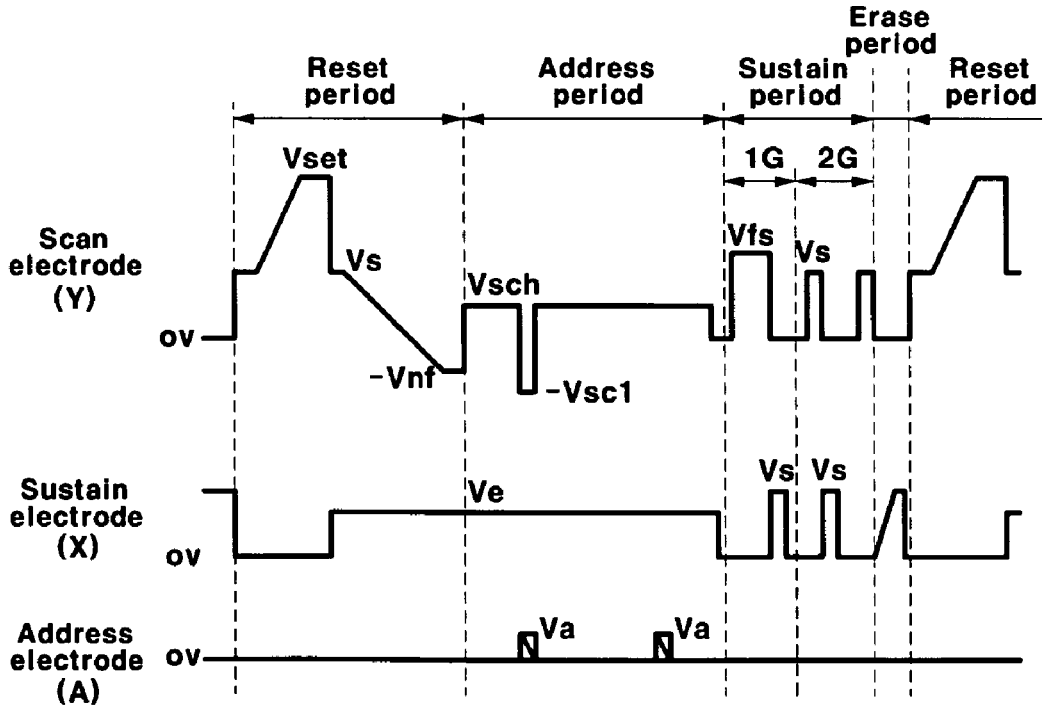
FIG. 2 shows a driving waveform of an AC PDP.
Figure 5:
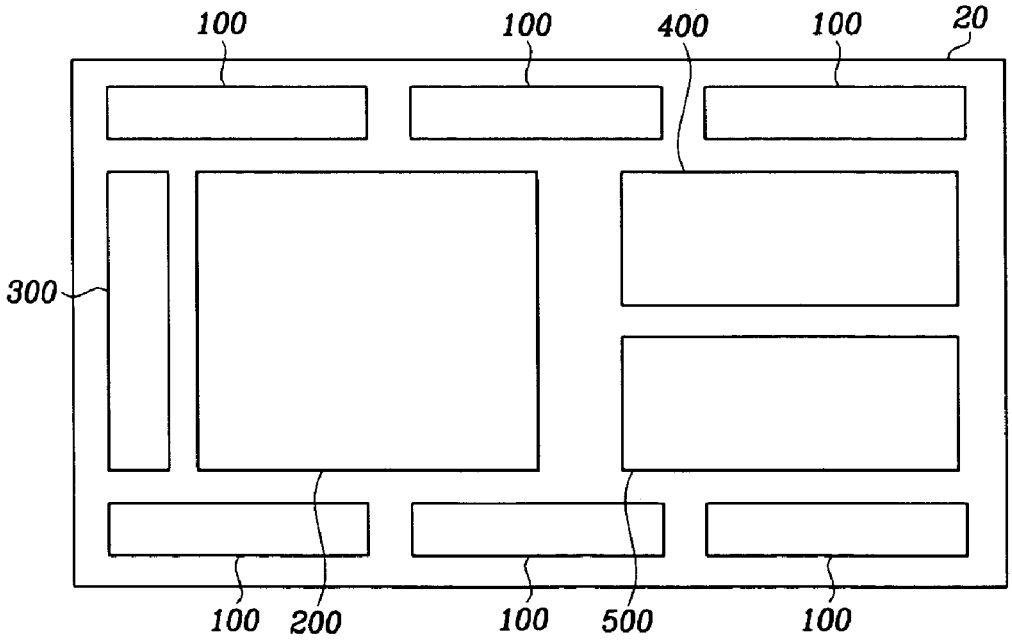
FIG. 5 shows a simplified plan view showing a chassis base according to an exemplary embodiment of the present invention.

In the embodiment shown in FIG. 5, the chassis base 20 includes boards 100, 200, 300, 400, 500 for driving of the PDP 10. Address buffer boards 100 are respectively arranged at the upper part and the lower part of the chassis base 20, and they can consist of a single board or a plurality of boards. FIG. 2 discloses the plasma display device wherein a dual driving method is performed. However, when a single driving method is applied, the address buffer board 100 is arranged at one space of the upper part or the lower part.

The address buffer board 100 receives an address driving control signal from an image processing and control board 400, and applies a voltage to each of address electrodes $A_1$ to $A_m$ to select a discharge cell that is desired to be displayed.

The scan driving board 200 is arranged at the left part of the chassis base 20 and is coupled to the scan electrodes $Y_1$ to $Y_n$ through the scan buffer board 300. The scan driving 200 board receives a driving signal from the image processing and control board 400 and applies a driving voltage to each of scan electrodes $Y_1$ to $Y_n$. At this time, the scan electrodes are grounded.

The scan buffer board 300 applies a voltage to the scan electrodes in an address period. The voltage is applied for selecting the scan electrodes $Y_1$ to $Y_n$ in order.

FIG. 5 discloses that the scan driving board 200 and the scan buffer board 300 are arranged at the left side of the chassis base 20, but the scan driving board 200 and the scan buffer board 300 can alternately be arranged at the right side of the chassis base 20. Further, the scan buffer board 300 can be integrated with the scan driving board 200.

The image processing and control board 400 receives an image signal externally, and generates a control signal for driving the address electrodes and a control signal for driving the scan electrodes, and respectively applies the control signals to the address driving board 100 and the scan driving board 200. A power board 500 applies power necessary to drive the plasma display device. The image processing and control board 400 and the power board 500 can be located at the middle of the chassis base 20.

Hereinafter, a driving waveform according to a driving circuit built in the scan driving board 200 and the scan buffer board 300 is described in more detail with reference to FIG. 6 to FIG. 13.

Figure 6:
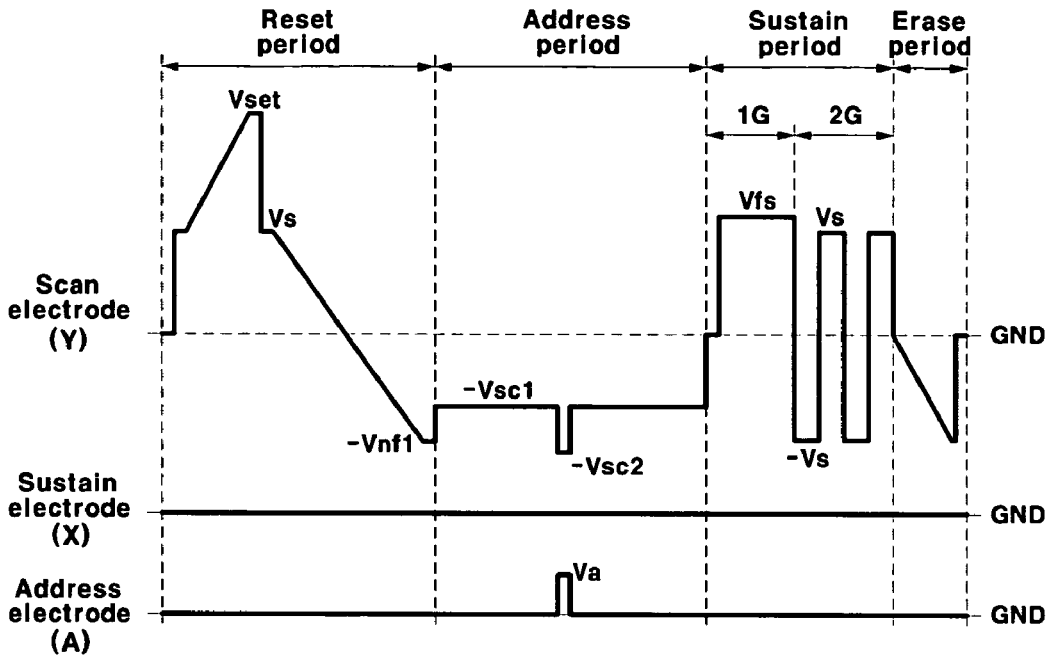
FIG. 6 shows a driving waveform of a PDP according to a first exemplary embodiment of the present invention.

First, a driving method of a PDP according to a first exemplary embodiment of the present invention is described with reference to FIG. 6, FIG. 7 and FIG. 8. FIG. 6 shows a driving waveform of a PDP according to a first exemplary embodiment of the present invention. Here, the driving waveform shown in FIG. 6 corresponds to a voltage difference between voltages which are applied to the scan electrode Y and the sustain electrode X.

First, according to the exemplary embodiment, a voltage is not applied to the sustain electrode X and driving pulses are applied to the scan electrode Y and the address electrode A.

As shown in FIG. 6, one subfield includes a reset period, an address period, a sustain period, and an erase period. The reset period includes a rising portion and a falling portion.

The erase period is a period for erasing a wall charge formed in a sustain period of the previous subfield. In the erase period, the voltage which is applied to the scan electrode Y gradually falls to −Vs voltage, after the final sustain discharge voltage Vs is applied to the scan electrode Y. However, the reference voltage is maintained. As such, a negative wall charge formed at the scan electrode Y and a positive wall charge formed at the sustain electrode due to the sustain discharge voltage Vs are removed due to the gradually falling voltage.

Next, in the rising portion of the reset period, the Vs voltage is applied to the scan electrode, and then the voltage which is applied to the scan electrode gradually rises to Vset voltage.

Then, in the falling portion of the reset period, the voltage which is applied to the scan electrode is decreased to Vs voltage, and then the voltage which is applied to the scan electrode gradually falls from the Vs voltage to $-V_{nf1}$. At this time, the $-V_{nf1}$ voltage is higher than a discharge firing voltage and is substantially equal to the voltage difference ($-V_{nf}-V_e$) between the voltages which are applied to the scan electrode Y and the sustain electrode X.

In the address period, the scan electrodes Y which are not selected are biased at $-V_{sc1}$ voltage, but $-V_{sc2}$ is applied to the scan electrodes Y which are selected. Then, the address voltage $V_a$ is applied to the address electrode A of the discharge cell that is desired to be selected among the discharge cells formed by the scan electrode Y to which the $-Vsc_2$ voltage is applied. At this time, the $-V_{sc1}$ voltage is substantially equal to the voltage difference $-V_{sch}-V_e$ between the voltages which are applied to the scan electrode Y and the sustain electrode X in FIG. 2, and the $-V_{sc2}$ voltage is substantially equal to the voltage difference $-V_{sc}-V_e$ between the voltages which are applied to the scan electrode Y and the sustain electrode X in FIG. 2.

Next, in the sustain period, a sustain discharge pulse which swings from the Vs voltage to −Vs voltage is applied to the scan electrode Y.

In the first exemplary embodiment, the sustain discharge pulse which is applied to the scan electrode is divided into a first group 1G and a second group 2G to properly achieve a sustain discharge. The first group 1G includes a first sustain discharge pulse which is applied after the address period. Here, a voltage $V_{fs}$ of the first sustain discharge pulse is higher than a voltage $V_s$ of the sustain discharge pulse which is applied to the second group 2G. The voltage $V_{fs}$ can be set between the voltage $V_s$ and the voltage $V_{smax}$. The voltage $V_{smax}$ is a voltage to which the erroneous discharge is fired when the voltage $V_{fs}$ is increased.

The width of the sustain discharge pulse of the first group 1G can be longer than the width of the sustain discharge pulse of the second group 2G. In addition, the voltage of the sustain discharge pulse of the first group 1G can be higher than the voltage of the sustain discharge pulse of the second 2G, and the width of the sustain discharge pulse of the first group 1G can be longer than the width of the sustain discharge pulse of the second group 2G at the same time.

Further, the width and the voltage Vs of the sustain discharge pulse of the first group 1G can be generally equal to the width and the voltage Vs of the sustain discharge pulse of the second group 2G.

Figure 7:
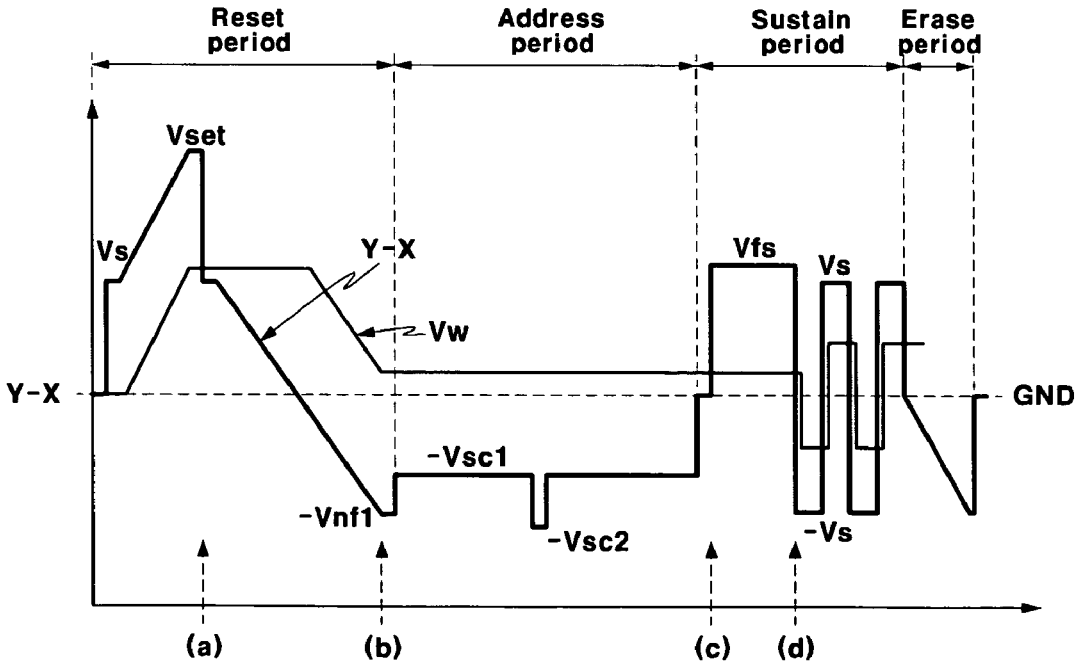
FIG. 7 shows correlation between a voltage difference and a wall charge, the voltage difference being a difference between a voltage applied to a scan electrode and a voltage applied to a sustain electrode in a driving waveform of FIG. 6.
Figure 8A:
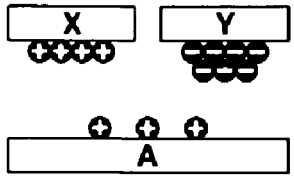
FIG. 8A to FIG. 8D show distributed wall charges according to a driving waveform of FIG. 6.
Figure 8B:
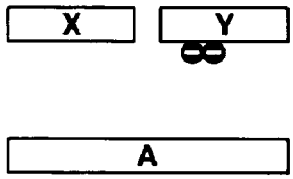
Figure 8C:
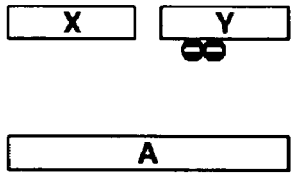
Figure 8D:
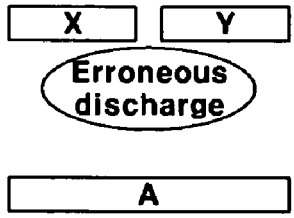

FIG. 7 shows the correlation between a voltage difference and a wall charge in the driving waveform of FIG. 6, the voltage difference being a difference between the voltage applied to a scan electrode and a voltage applied to a sustain electrode. FIG. 8A shows a distributed wall charge in the (a) part of the driving waveform of FIG. 6. FIG. 8B shows a distributed wall charge in the (b) part of the driving waveform of FIG. 6. FIG. 8C shows a distributed wall charge in the (c) part of the driving waveform of FIG. 6. FIG. 8D shows a distributed wall charge in the (d) part of the driving waveform of FIG. 6. The wall voltage in FIG. 7 indicates the wall voltage of a cell at which the addressing process is not performed.

Here, "wall charge" means a charge that is formed on a wall close to each electrode of the discharge cell and is accumulated on the electrode. The wall charge is described as being "formed" or "accumulated" on the electrode, although the wall charge does not actually contact the electrodes. Further, "wall voltage" means a potential difference formed on the wall of the discharge cell by the wall charge.

Generally, when a voltage between a scan electrode and an address electrode or a scan electrode and a sustain electrode becomes more than a discharge firing voltage, a discharge occurs between the scan electrode and the address electrode or the scan electrode and the sustain electrode. In particular, as shown in the first exemplary embodiment of the present invention, when a ramp voltage for discharge gradually rises or falls, a wall charge of a discharge cell is also gradually reduced at a speed that the ramp voltage rises or falls.

First, in a waveform according to the first exemplary embodiment of the present invention, a voltage difference between a scan electrode Y and a sustain electrode X formed by an external voltage is the same as the driving waveform which is applied to the scan electrode Y, since a voltage is not applied to the sustain electrode X.

As shown in FIG. 7, in a rising portion, the voltage difference between the scan electrode Y and the sustain electrode X by the external voltage gradually rises from a Vs voltage to a Vset voltage. As such, when a ramp voltage which gradually rises is applied such that a discharge occurs, a wall voltage $V_w$ in the discharge cell is also gradually reduced at a speed that the applying voltage rises. At this time, when the voltage difference between the scan electrode Y and the sustain electrode X by the external voltage becomes more than the discharge firing voltage $V_f$, a reset discharge occurs and a negative wall charge is formed at the scan electrode and a positive wall charge is formed at the sustain electrode and the address electrode as shown in FIG. 8A.

Then, in a falling portion, the voltage difference between the scan electrode Y and the sustain electrode X by the external voltage gradually falls from a Vs voltage to $-V_{nf1}$ voltage. At this time, before the falling ramp voltage is applied, since the negative wall charge is formed at the scan electrode and the positive wall charge is formed at the sustain electrode and the address electrode, a predetermined amount of wall voltage is generated. When the voltage difference between the wall charge $V_w$ and the applying voltage $V_{in}$ becomes more than the discharge firing voltage $V_f$, a weak discharge occurs and the wall voltage $V_w$ is gradually reduced along speed same to the applying voltage $V_{in}$. Then, the negative wall charge formed at the scan electrode and the positive wall charge formed at the sustain electrode and the address electrode are erased as in FIG. 8B. At this time, the final voltage which is applied to the scan electrode Y is higher than the discharge firing voltage, and thus all the wall charge is not erased at the scan electrode Y and some of the wall charge remains at the scan electrode Y.

Then, in an address period, cells being turned on and cells being turned off are selected, and a wall charge is accumulated on cells being turned on (addressed cell). At this time, since the discharge does not occur at cells which were not addressed, the wall voltage formed by the final voltage in the reset voltage is maintained as shown in FIG. 7.

Next, in a sustain period, a voltage Vfs of a first sustain discharge pulse for a sustain discharge is applied to the scan electrode. At this time, the wall charge condition shown in FIG. 8C is the same as the wall charge condition in FIG. 8B, since the discharge does not occur at the cells that were not addressed in the address period. Thus, when the positive voltage Vfs is applied to the scan electrode, the voltage becomes lower than the discharge firing voltage. The discharge therefore does not occur. Then, when the second sustain discharge pulse voltage −Vs is applied, the negative voltage −Vs is applied to the scan electrode on which the —wall charge was formed. Thus, erroneous discharge can occur at the cells in which the wall charge was not perfectly erased, or in cells having a lot of priming particles and abnormal cells.

Hereinafter, a driving waveform for manifesting the problem that the erroneous discharge can occur at the cells that were not addressed in the sustain period is described in detail with reference to FIG. 9, FIG. 10, FIG. 11A to FIG. 11D, FIG. 12, FIG. 13, and FIG. 14A to FIG. 14D.

Figure 9:
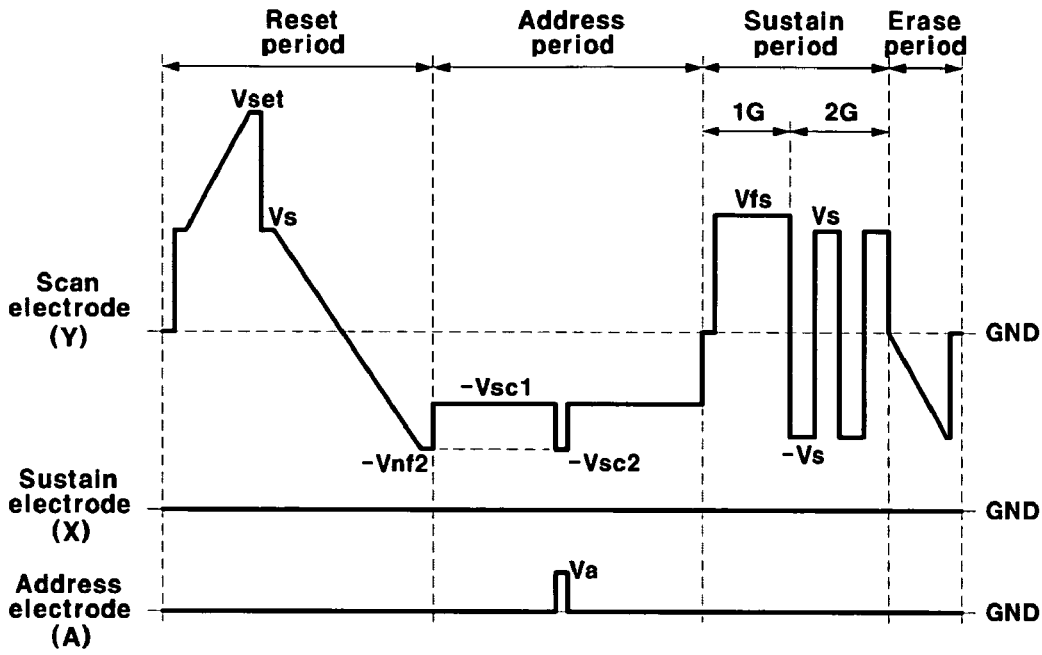
FIG. 9 shows a driving waveform of a PDP according to a second exemplary embodiment of the present invention.
Figure 10:
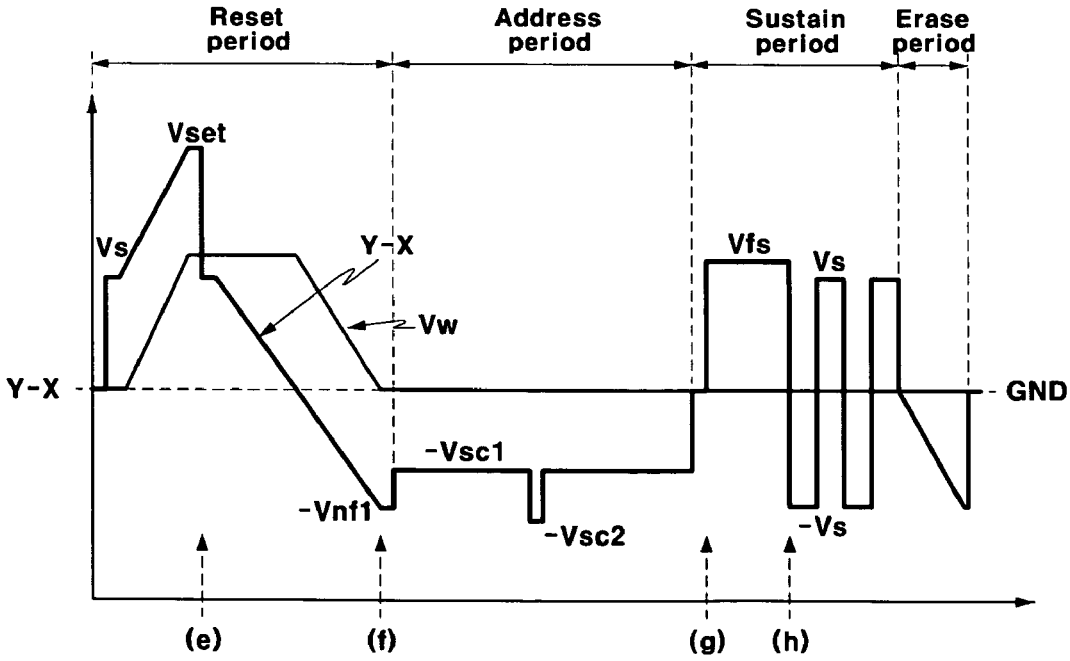
FIG. 10 shows a correlation between a voltage difference and a wall charge, the voltage difference being a difference between a voltage applied to a scan electrode and a voltage applied to a sustain electrode in a driving waveform of FIG. 9.
Figure 11A:
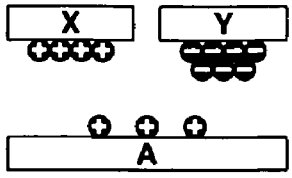
FIG. 11A to FIG. 11D show distributed wall charges according to a driving waveform of FIG. 9.
Figure 11B:
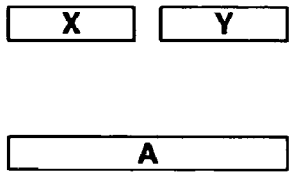
Figure 11C:
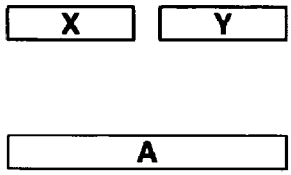
Figure 11D:
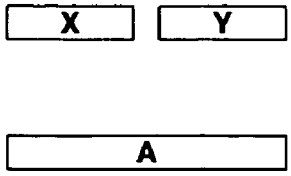

First, a driving waveform according to a second exemplary embodiment of the present invention is described with reference to FIG. 9, FIG. 10, and FIG. 11A to FIG. 11D. FIG. 9 shows a driving waveform of a PDP according to a second exemplary embodiment of the present invention. FIG. 10 shows a correlation between a voltage difference and a wall charge, the voltage difference being a difference between a voltage applied to a scan electrode and a voltage applied to a sustain electrode in a driving waveform of FIG. 9. FIG. 11A shows a distributed wall charge in an (e) period according to the driving waveform of FIG. 9. FIG. 11B shows a distributed wall charge in an (f) period according to the driving waveform of FIG. 9. FIG. 11C shows a distributed wall charge in a (g) period according to the driving waveform of FIG. 9. FIG. 11D shows a distributed wall charge in an (h) period according to the driving waveform of FIG. 9.

As shown in FIG. 9, a voltage which is applied to a scan electrode gradually falls from the Vs voltage to $-V_{nf2}$ voltage. Here, the $-V_{nt2}$ voltage is the same as the discharge firing voltage, and is smaller than the $-V_s$ voltage which is applied to the scan electrode Y during the sustain period. As such, a wall charge formed in a rising portion as shown in FIG. 11A is perfectly erased as shown in FIG. 11B. FIG. 10 shows a wall voltage formed by the wall charge.

Then, as shown in FIG. 11C and FIG. 11D, the wall charge condition of the cell that was not addressed in the sustain period is substantially the same as the wall charge condition in FIG. 11B. At this time, even when the voltage for a sustain discharge pulse is applied, the discharge does not occur. Thus, the wall charge condition in the sustain period is the same as the wall charge condition of FIG. 11B.

Figure 12:
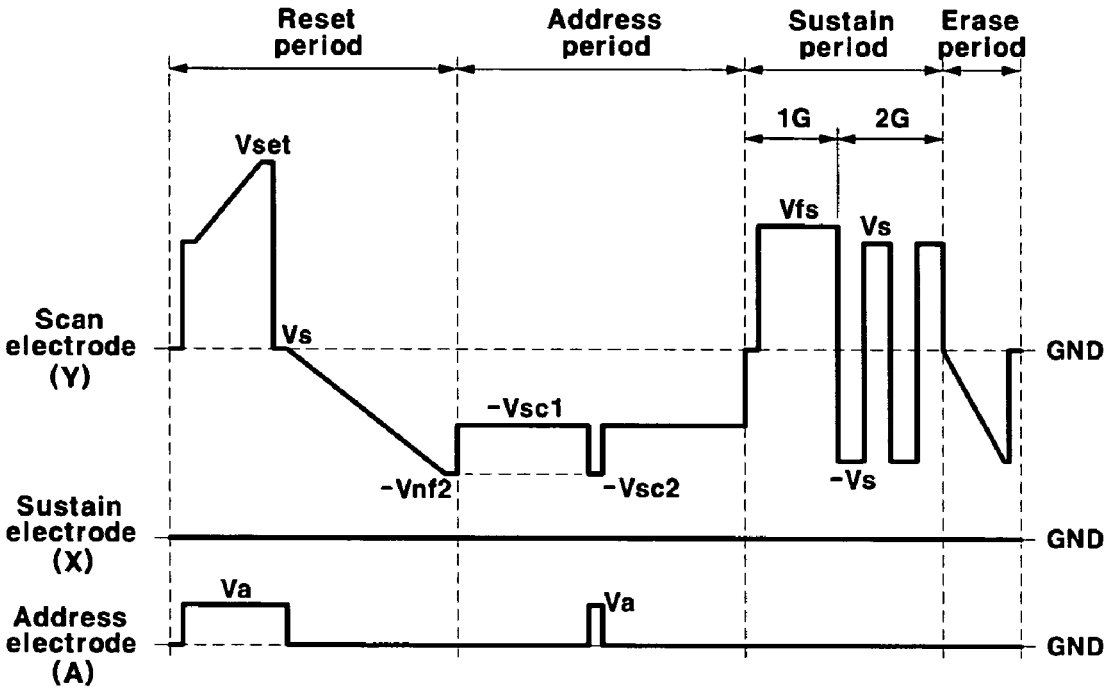
FIG. 12 shows a driving waveform of a PDP according to a third exemplary embodiment of the present invention.
Figure 13:
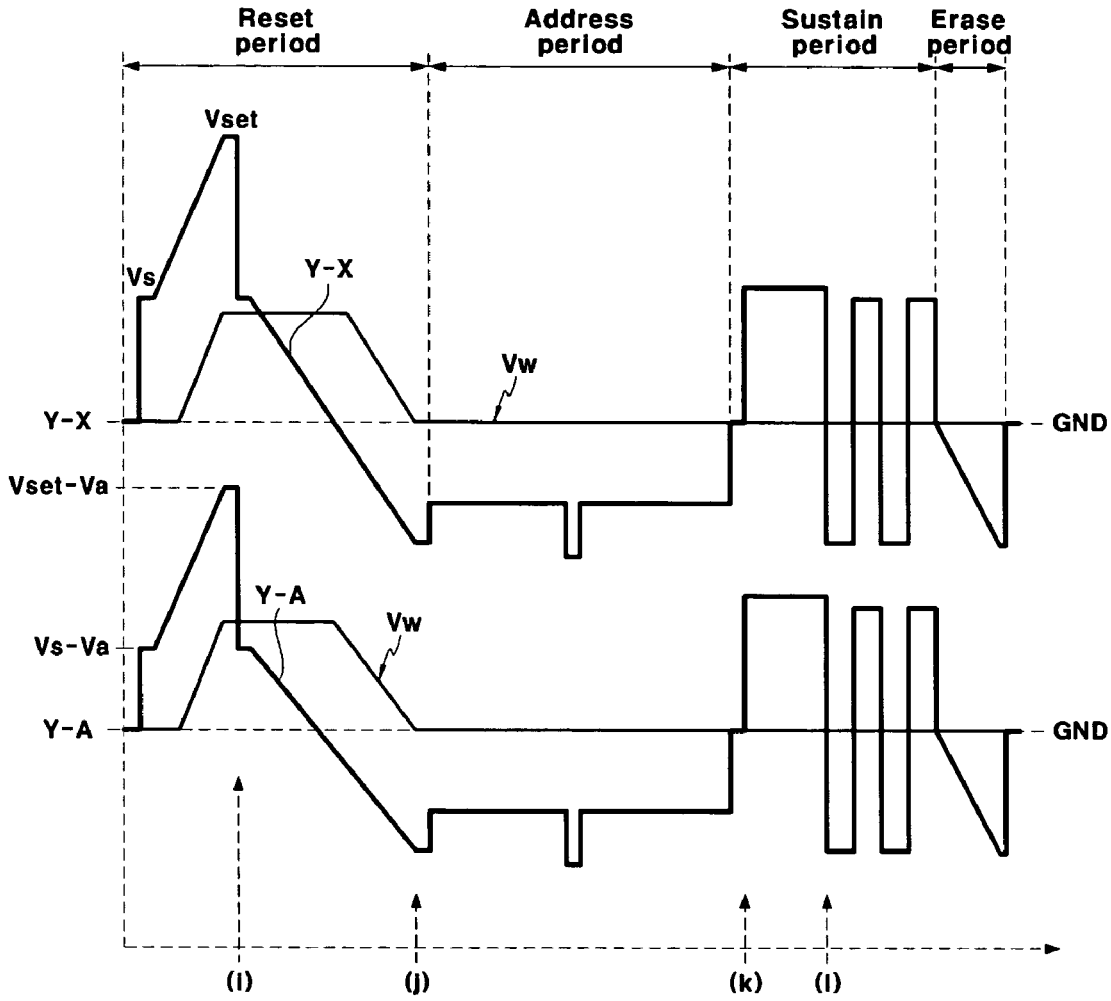
FIG. 13 shows a correlation between a voltage difference and a wall charge, the voltage difference being a difference between a voltage applied to a scan electrode and a voltage applied to a sustain electrode in a driving waveform of FIG. 12.
Figure 14A:
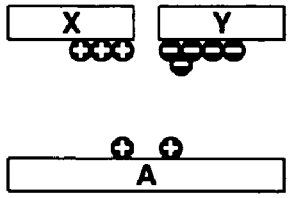
FIG. 14A to FIG. 14D show distributed wall charges according to a driving waveform of FIG. 12.
Figure 14B:
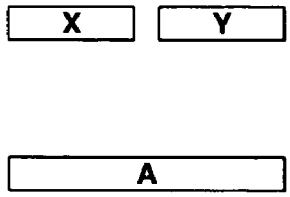
Figure 14C:
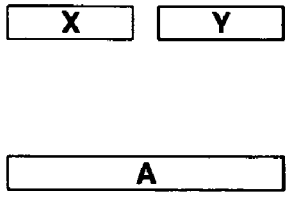
Figure 14D:
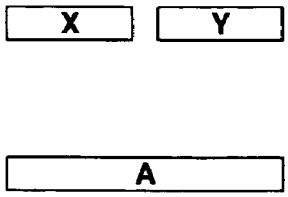

Next, a driving waveform according to a third exemplary embodiment of the present invention is described with reference to FIG. 12, FIG. 13, and FIG. 14A to FIG. 14D. FIG. 12 shows a driving waveform of a PDP according to a third exemplary embodiment of the present invention. FIG. 13 shows correlation between a voltage difference and a wall charge, the voltage difference being a difference between a voltage applied to a scan electrode and a voltage applied to a sustain electrode in a driving waveform of FIG. 12. FIG. 14A shows a distributed wall charge in an (i) period according to the driving waveform of FIG. 12. FIG. 14B shows a distributed wall charge in a (j) period according to the driving waveform of FIG. 12. FIG. 14C shows a distributed wall charge in a (k) period according to the driving waveform of FIG. 12. FIG. 14D shows a distributed wall charge in an (l) period according to the driving waveform of FIG. 12.

As shown in FIG. 12, in a rising portion of a reset period, first, a Vs voltage is applied to a scan electrode. Then the voltage which is applied to the scan electrode gradually rises to a Vset voltage, while an address voltage Va is applied to an address electrode. At this time, as shown in FIG. 13, a voltage difference between the scan electrode Y to which the voltage is externally applied and the address electrode A gradually rises from $V_s-V_a$ voltage to $V_{set}-V_a$ voltage. Thus, the discharge occurs later than the discharge when the waveform of FIG. 6 is applied. Therefore, as shown in FIG. 14A, the amount of the wall charge formed on the scan electrode Y, the sustain electrode X, and the address electrode A is reduced and the wall voltage by the wall charge is also reduced. After all, even if the final voltage which is applied to the scan electrode Y in the falling portion of the reset period is higher than the lower voltage among the voltages which are applied for the sustain discharge in the sustain period as shown in FIG. 6, the wall charge formed on each electrode in the rising portion of the reset period can be erased as shown in FIG. 14B.

Thus, as shown in FIG. 14C to FIG. 14D, the wall charge condition in the cells which were not addressed in the sustain period of the waveform is the same as the wall charge condition in FIG. 14B, and when the voltage for the sustain discharge is applied under such condition, the discharge does not occur. Thus, the wall charge condition in the sustain discharge is maintained as FIG. 14B.

As mentioned above, according to the present invention, when a sustain electrode is biased at a predetermined voltage, a driving waveform is applied to a scan electrode, and thus a board for driving the sustain electrode can be removed. That is, a PDP can be substantially driven by using two boards, thus the cost for the boards can be reduced.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A driving method of a plasma display panel having a plurality of first electrodes, a plurality of second electrodes, and a plurality of third electrodes which lie in a direction perpendicular to the first electrodes and the second electrodes, the plurality of first electrodes, the plurality of second electrodes, and the plurality of third electrodes being responsive to waveforms having subfields which have a reset period, an address period, and a sustain period, the method comprising:

biasing the second electrodes at a first voltage during the reset period, the address period, and the sustain period;

increasing a voltage of the first electrodes from a second voltage to a third voltage;

and decreasing the voltage of the first electrodes from a fourth voltage to a fifth voltage during the reset period, wherein the fifth voltage is lower than the lower voltage among voltages that are applied for a sustain discharge in the sustain period.

2. The driving method of the plasma display panel of claim 1, wherein the first voltage is a grounded voltage.

3. The driving method of the plasma display panel of claim 1, wherein a voltage difference between the fifth voltage and the first voltage is a discharge firing voltage.

4. The driving method of claim 1, further comprising maintaining the address electrodes at ground potential other than when addressing discharge cells during the address period.

5. The driving method of claim 1, further comprising maintaining the address electrodes at ground potential other than during the first portion of the reset period and when addressing discharge cells during the address period.

6. A driving method of a plasma display panel having a plurality of first electrodes, a plurality of second electrodes, and a plurality of third electrodes which lie in a direction perpendicular to the first electrodes and the second electrodes, the plurality of first electrodes, the plurality of second electrodes, and the plurality of third electrodes being responsive to waveforms having subfields which have a reset period, an address period, and a sustain period, the method comprising:

biasing the second electrodes at a first voltage during the reset period, the address period, and the sustain period;

increasing a voltage of the first electrodes from a second voltage to a third voltage;

and decreasing the voltage of the first electrodes from a fourth voltage to a fifth voltage during the reset period, wherein the fifth voltage is lower than the lower voltage among voltages that are applied for a sustain discharge in the sustain period, wherein the alternating voltage level sustain discharge pulse during the sustain period includes a first sustain discharge pulse group and a following second sustain discharge pulse group.

7. The driving method of claim 6, wherein the first sustain discharge pulse group has a voltage level higher than a voltage level of the second sustain discharge pulse group.

8. The driving method of claim 6, wherein the first sustain discharge pulse group has a pulse width longer than a pulse width of the second sustain discharge pulse group.

* * * * *